US009148932B2

(12) United States Patent
Horn

(10) Patent No.: US 9,148,932 B2
(45) Date of Patent: Sep. 29, 2015

(54) DIMMER SWITCH HAVING AN ALTERNATE FADE RATE WHEN USING IN CONJUNCTION WITH A THREE-WAY SWITCH

(71) Applicant: Lutron Electronics Co., Inc., Coopersburg, PA (US)

(72) Inventor: William D. Horn, Allentown, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 167 days.

(21) Appl. No.: 13/774,991

(22) Filed: Feb. 22, 2013

(65) Prior Publication Data

US 2013/0271025 A1 Oct. 17, 2013

Related U.S. Application Data

(60) Provisional application No. 61/622,718, filed on Apr. 11, 2012.

(51) Int. Cl.
*H05B 41/16* (2006.01)
*H05B 37/02* (2006.01)

(52) U.S. Cl.
CPC ..... *H05B 37/02* (2013.01)

(58) Field of Classification Search
None
See application file for complete search history.

(56) References Cited

U.S. PATENT DOCUMENTS

| | | | | |
|---|---|---|---|---|
| 5,248,919 | A * | 9/1993 | Hanna et al. | 315/291 |
| 5,430,356 | A * | 7/1995 | Ference et al. | 315/291 |
| 7,071,634 | B2 | 7/2006 | Johnson et al. | |
| 7,166,970 | B2 | 1/2007 | Johnson et al. | |
| 7,190,125 | B2 | 3/2007 | McDonough et al. | |
| 7,247,999 | B2 | 7/2007 | Kumar | |
| 7,382,100 | B2 | 6/2008 | Johnson et al. | |
| 7,663,325 | B2 | 2/2010 | McDonough et al. | |
| 7,948,393 | B2 * | 5/2011 | Nearhoof et al. | 340/815.4 |
| 8,143,806 | B2 * | 3/2012 | Mosebrook et al. | 315/291 |
| 8,207,821 | B2 * | 6/2012 | Roberge et al. | 340/9.11 |
| 8,212,424 | B2 * | 7/2012 | Mosebrook et al. | 307/139 |
| 8,212,425 | B2 * | 7/2012 | Mosebrook et al. | 307/139 |
| 8,212,486 | B2 * | 7/2012 | Biery et al. | 315/149 |
| 8,803,436 | B2 * | 8/2014 | Newman et al. | 315/246 |
| 2010/0138067 | A1 * | 6/2010 | Mosebrook et al. | 700/295 |
| 2011/0187282 | A1 * | 8/2011 | Biery et al. | 315/291 |
| 2012/0230073 | A1 * | 9/2012 | Newman et al. | 363/126 |
| 2013/0170263 | A1 * | 7/2013 | Newman et al. | 363/126 |
| 2013/0271025 | A1 * | 10/2013 | Horn | 315/246 |
| 2014/0117859 | A1 * | 5/2014 | Swatsky et al. | 315/158 |

* cited by examiner

*Primary Examiner* — Douglas W Owens
*Assistant Examiner* — Srinivas Sathiraju
(74) *Attorney, Agent, or Firm* — Condo Roccia Koptiw LLP

(57) ABSTRACT

A dimmer switch uses different fade rates when turning on or off lighting load depending on a device used to adjust the lighting load. For example, the dimmer switch uses a first fade rate when turning off a lighting load in response to an actuation of a local actuator or accessory switch and uses a second fade rate faster than the first fade rate when turning off the lighting load in response to an actuation of a connected three-way switch may be provided. The dimmer switch may slowly turn off the lighting load in response to an actuation of the actuator to provide an aesthetically pleasing reduction in the intensity of the lighting load. When a user actuates the three-way switch to turn off the lighting load, the dimmer switch quickly reduces the intensity of the lighting load to approximately zero percent as may be expected by the user.

23 Claims, 5 Drawing Sheets

DIMMER SWITCH HAVING AN ALTERNATE FADE RATE WHEN USING IN CONJUNCTION WITH A THREE-WAY SWITCH

CROSS-REFERENCE TO RELATED APPLICATIONS

This application claims the benefit of U.S. Provisional Patent Application No. 61/622,718, filed on Apr. 11, 2012, the disclosure of which is incorporated herein by reference in its entirety.

BACKGROUND

Three-way switching systems enable controlling electrical loads such as lighting loads from multiple control locations. These three-way switching systems include three-way switches that, for example, are wired to a building's alternating-current (AC) wiring system, are subjected to AC source voltage, and/or carry full load current as opposed to low-voltage switch systems that operate at low voltage and low current and communicate digital commands (e.g., usually low-voltage logic levels) to a remote controller that controls the level of AC power delivered to the load in response to the commands. As such, the "three-way switch" or "three-way system" include switches and systems that are subjected to the AC source voltage and carry the full load current.

Additionally, three-way switching system includes two three-way switches for controlling a single load where each switch is fully operable to independently control the load irrespective of the status of the other switch. In such a system, one three-way switch is typically wired at the AC source side of the system (e.g., at or on "line side"), and the other three-way switch is typically wired at the load side of the system. For example, FIG. 1 shows a standard three-way switch system 100 that includes two three-way switches 102, 104. The two three-way switches 102, 104 are connected between an AC power source 106 and a lighting load 108. When the three-way switches 102, 104 are both in position A or both in position B, the electrical circuit is complete and the lighting load 108 is energized. When one three-way switch 102 is in position A and the other three-way switch 104 is in position B or vice versa, the electrical circuit is not complete and the lighting load 108 is off.

Three-way dimmer switches can also replace three-way switches. For example, FIG. 2 depicts a simplified diagram of an example of a three-way dimming system 200 that includes a three-way dimmer switch 202 and a standard three-way switch 104. As shown in FIG. 2, the three-way dimmer switch 202 includes a dimmer circuit 210 and a three-way switch 212. The dimmer circuit 210 typically includes a bidirectional semiconductor switch such as a triac for regulating the amount of energy supplied to the lighting load 108. Specifically, the dimmer circuit 210 conducts load current to the lighting load 108 for some portion of each half-cycle of the AC waveform and does not conduct the load current to the load for the remainder of the half-cycle. Because the dimmer switch 202 is in series with the lighting load 108, the longer the dimmer switch conducts the load current, the more energy will be delivered to the lighting load 108. When the lighting load 108 is a lamp, the more energy delivered to the lighting load 108, the greater the light intensity level of the lamp. In a typical dimming scenario, a user may adjust a control of a user interface of the dimmer switch 202 to set the light intensity level of the lamp to a desired light intensity level. The portion of each half-cycle for which the dimmer switch 202 conducts is based on the selected light intensity level. As shown in FIG. 2, today, the three-way dimming system 200 includes one three-way dimmer switch 202, which can be located on either the line side or the load side of the system as, currently, two dimmer circuits such as the dimmer switch 202 can not be wired in series.

Additionally, three-way dimming systems such as the three-way dimming system 200 shown in FIG. 2 can employ a "smart" dimmer switch and/or a specially designed auxiliary (e.g., remote) switch that permits the dimming level to be adjusted from multiple locations. A smart dimmer is a dimmer that includes a microcontroller or other processing components for enabling an advanced set of control features and feedback options to the end user. To power the microcontroller, smart dimmers include power supplies that draw a small amount of leakage current through the lighting load each half-cycle when the bidirectional semiconductor switch of the dimmer circuit 210 shown in FIG. 2 is non-conductive. The power supply uses this small amount of current to charge a capacitor and develop a direct-current (DC) voltage to power the microcontroller. No load current flows through the dimmer circuit 210 shown in FIG. 2 of the three-way dimmer switch 202 when the circuit between the AC power source 106 and the lighting load 108 is broken by either three-way switch 212, 104. As such, currently, the dimmer switch 202 can not include a power supply and a microcontroller and still operate to properly provide the advanced set of features to the end user when the lighting load 108 is on and off.

To provide such a "smart" dimmer system, multiple lighting controls can also be used. FIG. 3 shows an example multiple location lighting control system 300 that can provide such a "smart" dimmer system. As shown in FIG. 3, the multiple location lighting control system 300 includes a wall-mountable smart dimmer switch 302 and a wall-mountable remote switch 304 (e.g., an accessory control). The dimmer switch 302 has a hot terminal H for receipt of the AC source voltage provided by the AC power supply 106, and a dimmed-hot terminal DH for providing the dimmed-hot voltage to the lighting load 108. The accessory control 304 is connected in series with the dimmed-hot terminal DH of the dimmer switch 302 and the lighting load 108 such that the accessory control 304 passes the dimmed-hot voltage through to the lighting load. The multiple location lighting control system 300 is described in greater detail in commonly-assigned U.S. Pat. No. 5,248,919, issued on Sep. 28, 1993, entitled LIGHTING CONTROL DEVICE, and U.S. Pat. No. 5,798,581, issued Aug. 25, 1998, entitled LOCATION INDEPENDENT DIMMER SWITCH FOR USE IN MULTIPLE LOCATION SWITCH SYSTEM, AND SWITCH SYSTEM EMPLOYING SAME, the entire disclosure of which is hereby incorporated by reference.

Additionally, the dimmer switch 302 and the accessory control 304 both have actuators to enable toggling the lighting load 108 on and off and/or for raising and lowering the intensity of the lighting load. The dimmer switch 302 is responsive to actuation or selection of the actuators to turn the lighting load 108 on or off or adjust the intensity level of the lighting load from a minimum intensity (e.g., approximately 0%) to a maximum intensity (e.g., approximately 100%). In addition, the dimmer switch 302 may control the intensity of the lighting load 108 to a preset intensity between the minimum and maximum intensities. When turning the lighting load 108 on and/or off, the dimmer switch 302 is operable to fade the intensity of the lighting load by increasing or decreasing the intensity of the lighting load from the minimum intensity to the preset intensity (e.g., or from the present intensity to the minimum intensity) over a predetermined amount of time (i.e., at a fade rate). The dimmer switch 302 uses a slow turn-off time (e.g., approximately 2.5 sec) to gradually turn off the lighting load 108, which provides an aesthetically pleasing reduction in the intensity of the lighting load and provides the user with a few seconds to exit the room in which the lighting load is located before the lighting load is completely off. The smart dimmer switch 302 can also include a linear array of visual indicators (not shown) that are illuminated to provide feedback of the intensity of the lighting load 108.

Actuation or selection of one of the actuators at the accessory control 304 causes an AC control signal, or a partially-rectified AC control signal, to be communicated from that accessory control to the dimmer switch 302 over the wiring between the accessory-dimmer terminal AD of the accessory control and the accessory-dimmer terminal AD of the dimmer switch. The actuators of the accessory control 304 contact momentary tactile switches inside the accessory control, such that the dimmer switch 302 receives short pulse signals from the accessory control (e.g., 100-200 milliseconds in length) representing a closure of one of the momentary switches in accessory control. The dimmer switch 302 is responsive to the control signal to alter the dimming level or toggle the lighting load 108 on and off. Thus, the lighting load 108 can be fully controlled from the accessory control 304.

Although the multiple location lighting control system 300 shown in FIG. 3 enables the use of a smart dimmer switch in a three-way system, a customer may need to purchase the accessory control 304 along with the smart dimmer switch 302. Often, the typical customer is unaware that an accessory control is used or needed when buying a smart dimmer switch for a three-way system until after the time of purchase when the smart dimmer switch is installed and it is discovered that the smart dimmer will not work properly with the existing three-way switch.

Additionally, to provide a "smart" dimmer system, a "smart" three-way dimmer switch may be used with a typical or standard three-way switch. FIG. 4 illustrate a diagram of a example three-way dimming system 400 that includes a smart three-way dimmer switch 402 that is operable to work with a standard maintained three-way switch 404. Thus, there is no need for the installer to purchase a unique accessory control to replace the three-way switch 404. The smart three-way dimmer switch 402 is wired in place of a previously installed switch or dimmer switch (e.g., the three-way switch 102 shown in FIG. 1 or the dimmer switch 202 shown in FIG. 2). To provide such a system, a simple rewiring 410 can be carried out in the wallbox of the three-way switch 404 to disconnect the dimmed-hot terminal DH of the smart three-way dimmer switch 402 from the first switch position of the three-way switch 404 (i.e., position A in FIG. 4) and to connect the dimmed-hot terminal DH to the lighting load 108. The other switch position of the three-way switch 404 (i.e., position B in FIG. 4) is connected to the accessory-dimmer terminal AD of the smart three-way dimmer switch 402.

As such, the smart three-way dimmer switch 402 shown in FIG. 4 is connected between the AC power source 106 and the lighting load 108 independent of the position of three-way switch 404. The three-way switch 404 now operates by either connecting the dimmed-hot voltage to or disconnecting the dimmed-hot voltage from the accessory-dimmer terminal AD on the smart three-way dimmer switch. The smart three-way dimmer switch 402 can also be wired to the load side of system 400 and operation of the three-way switch 404 would connect and disconnect the AC power source voltage to and from the accessory-dimmer terminal AD on the smart three-way dimmer switch. Also, a two-way switch an be used in place of three-way switch 404 since the first position A is not being used. Rather than receiving a signal at the accessory-dimmer terminal AD that is a short pulse (i.e., representing a closure of one of the momentary switches in the accessory control 304), the smart three-way dimmer switch 402 determines when the voltage at the accessory-dimmer terminal AD changes states (i.e., from an AC line voltage signal to zero volts, and vice versa). Based on this determination, the smart three-way dimmer switch 402 toggles the state of the lighting load 108. The three-way dimming system 400 of FIG. 4 is described in greater detail in commonly-assigned U.S. Pat. No. 7,247,999, issued Jul. 24, 2007, entitled DIMMER FOR USE WITH A THREE-WAY SWITCH, the entire disclosure of which is hereby incorporated by reference.

The dimmer switch 402 of the three-way dimmer system 400 shown in FIG. 4 may use a the slow turn-off fade rate (i.e., approximately 2.5 seconds) to gradually turn off the lighting load. While this gradual adjustment of the intensity of the lighting load 108 provides benefits to the user as previously mentioned, the reduction may not be immediately perceptible by the human eye. A user of the smart dimmer switch 302 or the accessory control 304 of the lighting control system 300 shown in FIG. 3 may be aware of the slow turn-off rate provided by the smart dimmer switch. Unfortunately, the user of the standard three-way switch 404 of the dimming system 400 may expect the intensity of the lighting load 108 to change rapidly when the lighting load is turned off. Since the dimmer switch 402 uses the slow turn-off or turn-on fade rate, the adjustment of the intensity of the lighting load 108 in response to an actuation of the three-way switch typically is not immediately noticed by the user. As such, the user can become confused causing the user to once again actuate the three-way switch 404 and, thus, change the intensity to an undesired level and/or even conclude that the three-way switch is not functioning correctly.

SUMMARY

A multiple location load control system may be provided. The multiple location load control system may enable the amount of power delivered from an alternating-current (AC) power source to an electrical or lighting load to be controlled. For example, a load control device such as a dimmer switch or an accessory switch may be adapted to be used in combination with a standard three-way switch (e.g., a toggle switch) where the dimmer switch or accessory switch and the standard three-way switch may control the lighting load. The dimmer switch or accessory switch may be operable to use a first fade rate when turning on or off a lighting load in response to an actuation of a local actuator (e.g., an actuator of the dimmer switch or accessory switch) and a second fade rate that may be faster than the first fade rate when turning on or off the lighting load in response to an actuation of the standard three-way switch, such that the adjustment of the intensity of the lighting load in response to the actuation of the dimmer switch or accessory switch may be gradual and the adjustment of the intensity of the three-way switch may be fast or immediate as expected by a user thereof.

For example, a dimmer switch for controlling the amount of power delivered from an AC power source to a lighting load may be adapted to be coupled to a standard three-way switch where the standard three-way switch may be coupled to a source and/or the load. The dimmer switch may include a controllably conductive device adapted to be coupled in series electrical connection between the source and the load, an actuator operable to receive a user input, a controller operatively coupled to the actuator, a control input of the controllably conductive device for controlling the power delivered to the lighting load, and/or an external-control terminal adapted to receive an external control signal from the three-way switch. The controller may be operable to turn off or even turn on the lighting load at a first turn-off or turn-on rate in response to an actuation of the actuator, may be operatively coupled to the external-control terminal for receipt of the external control signal, and/or may be operable to turn off or even turn on the lighting load in response to the external control signal at a second turn-off or turn on rate faster than the first turn-off or turn-on rate. The first and second turn-off or turn-on rates may provide an adjustment of the intensity of the lighting load in response to the actuation of the dimmer switch (e.g., gradual) and the three-way switch (e.g., fast or immediate) expected by a user thereof.

Additionally, a dimmer switch for controlling the amount of power delivered from an AC power source to a lighting load may be adapted to be coupled to one of an accessory control having a momentary actuator and a standard maintained three-way switch where the standard maintained three-way switch may be coupled to one of the source and the load. The dimmer switch may include a controllably conductive device adapted to be coupled in series electrical connection between the source and the load, a controller operatively coupled to a control input of the controllably conductive device for controlling the power delivered to the lighting load, and/or an external-control terminal adapted to be coupled to either the accessory control or the three-way switch. The controller may operate in a momentary mode of operation when the accessory control may be coupled to the external-control terminal and in a maintained mode of operation when the three-way switch maybe coupled to the external-control terminal. Additionally, the controller may be operable to turn off the lighting load at a first turn-off rate in response to an actuation of the actuator of the accessory control and/or to turn off the lighting load at a second turn-off rate faster than the first turn-off rate in response to an actuation of the three-way switch. The first and second turn-off or turn-on rates may provide an adjustment of the intensity of the lighting load in response to the actuation of the accessory switch (e.g., gradual) and the three-way switch (e.g., fast or immediate) expected by a user thereof.

DETAILED DESCRIPTION

Figure 5:
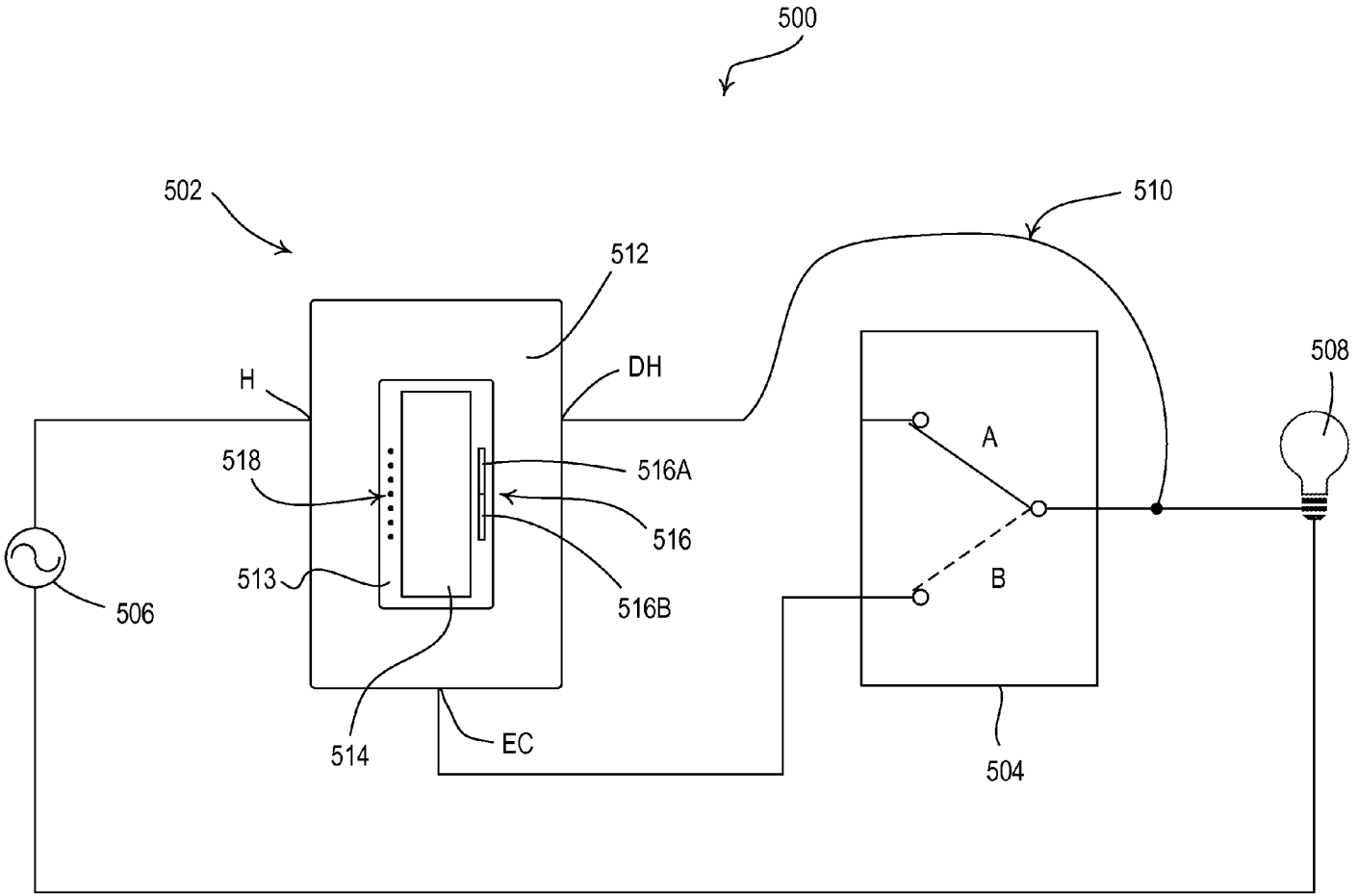
FIG. 5 is a bock diagram of a multiple location lighting control system.

FIG. 5 is a diagram of an example multiple location lighting control system 500. The lighting control system 500 includes a smart dimmer switch 502 and a standard maintained three-way switch 504 coupled between an AC power source 506 and a lighting load 508 to control the intensity of the lighting load. To couple the dimmed-hot terminal DH of the smart three-way dimmer switch 502 directly to the lighting load 108, a rewiring 510 may be used or implemented in a wallbox of the three-way switch 504. The dimmer switch 502 may be connected to the three-way switch 504 via an external-control terminal EC via the other electrical conductor between the dimmer switch 502 and the three-way switch 504.

The dimmer switch 502 may include a faceplate 512, a bezel 513 received in an opening of the faceplate, a toggle actuator 514, and/or an intensity adjustment actuator 516. Actuations of the toggle actuator 514 toggle (i.e., turn off and on) the lighting load 508. Additionally, actuations of an upper portion 516A or a lower portion 516B of the intensity adjustment actuator 516 respectively increase or decrease the amount of power delivered to the lighting load 508 and, as such, increase or decrease the intensity of the lighting load from a minimum intensity (e.g., 1%) to a maximum intensity (e.g., 100%). A plurality of visual indicators 518 may be arranged in a linear array on the left side of the bezel 513 and may be illuminated to provide feedback of the intensity of the lighting load 508.

The controller 524 may also be responsive to "advanced" actuations of the toggle actuator 514. For example, the dimmer switch 502 may quickly turn on to the maximum intensity in response to a double tap of the toggle actuator 514 (e.g., two actuations of the toggle actuator in quick succession). In addition, the dimmer switch may slowly fade off from the present intensity in response to a press and hold of the toggle actuator 514. Examples of such advanced actuations of the toggle actuator 514 are described in greater detail in previously-referenced U.S. Pat. No. 5,248,919, as well as U.S. Pat. No. 7,071,634, issued Jul. 4, 2006, entitled LIGHTING CONTROL DEVICE HAVING IMPROVED LONG FADE OFF, the entire disclosure of which is hereby incorporated by reference.

Figure 6:
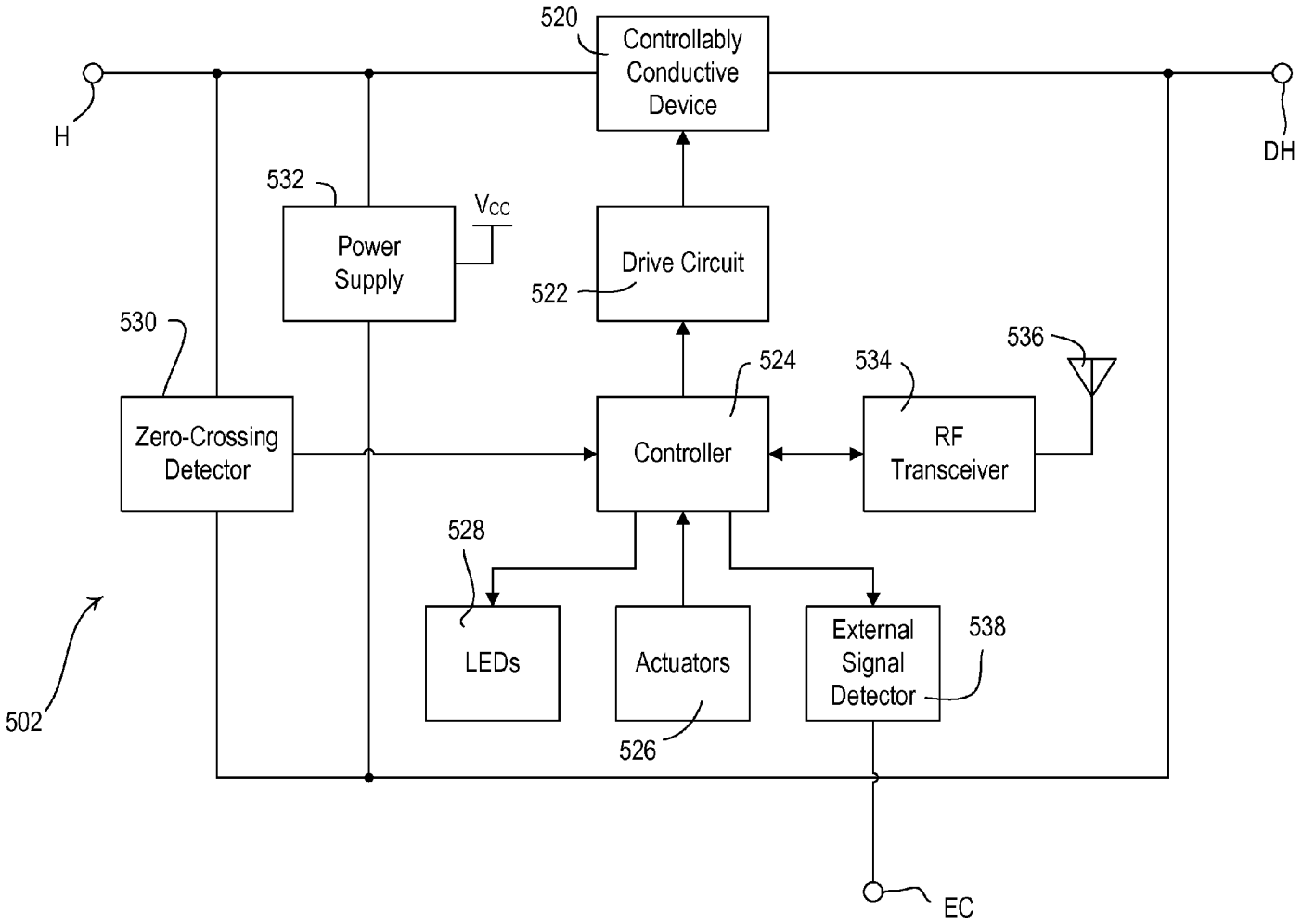
FIG. 6 is a block diagram of a dimmer switch of the lighting control system of FIG. 5.

FIG. 6 illustrates a block diagram of the dimmer switch 502 of FIG. 5. As shown in FIG. 6, the dimmer switch 502 may include a controllably conductive device 520 coupled in series electrical connection between the AC power source 506 and the lighting load 508 shown in FIG. 5 that may be used to control the power delivered to the lighting load. The controllably conductive device 520 may include any suitable type of bidirectional semiconductor switch such as, for example, a triac, a field-effect transistor (FET) in a rectifier bridge, FETs in anti-series connection, or one or more insulated-gate bipolar junction transistors (IGBTs).

As shown in FIG. 6, the dimmer switch 502 may include a controller 524. The controller 524 may be operatively coupled to a control input of the controllably conductive device 520 via a gate drive circuit 522. For example, the controller 524 may render the controllably conductive device 520 conductive or non-conductive to, thus, control the amount of power delivered to the lighting load 508.

The controller 524 may include, for example, a microprocessor or any suitable processing device such as a programmable logic device (PLD), a microcontroller, an application specific integrated circuit (ASIC), or a field programmable gate array (FPGA). Additionally, the controller 524 may receive inputs from local actuators 526 (i.e., the toggle actuator 514 and the intensity adjustment actuator 516), and may control (e.g., individually) a plurality of light-emitting diodes (LEDs) 528 to illuminate the linear array of visual indicators 518. The controller 524 may also receive a zero-crossing control signal representative of the zero-crossing points of the AC mains line voltage of the AC power source 506 from a zero-crossing detector 529 such that, in an example, the controller 524 may be operable to render the controllably conductive device 520 conductive and non-conductive at predetermined times relative to the zero-crossing points of the AC waveform using a phase-control dimming technique.

As shown in FIG. 6, the dimmer switch 502 may further include a power supply 532. The power supply 532 may generate a direct-current (DC) supply voltage $V_{CC}$. The DC supply voltage $V_{CC}$ may be used to power the controller 524 and/or other low-voltage circuitry of the dimmer switch 502.

Additionally, the dimmer switch 502 may include a wireless communication circuit, e.g., a radio-frequency (RF) transceiver 534, which may be coupled to an antenna 536 for transmitting and/or receiving messages or data (e.g., digital messages) via RF signals. For example, in response to the digital messages received via the RF signals, the controller 524 may be operable to control the controllably conductive device 520 to adjust the intensity of the lighting load 508. The controller 524 may also transmit feedback information regarding the amount of power being delivered to the lighting load 508 via the digital messages included in the RF signals. Examples of wall-mounted RF dimmer switches are described in greater detail in U.S. Pat. No. 5,982,103, issued Nov. 9, 1999, and U.S. Pat. No. 7,362,285, issued Apr. 22, 2008, both entitled COMPACT RADIO FREQUENCY TRANSMITTING AND RECEIVING ANTENNA AND CONTROL DEVICE EMPLOYING SAME; U.S. Pat. No. 5,905,442, issued May 18, 1999, entitled METHOD AND APPARATUS FOR CONTROLLING AND DETERMINING THE STATUS OF ELECTRICAL DEVICES FROM REMOTE LOCATIONS; and U.S. patent application Ser. No. 12/033,223, filed Feb. 19, 2008, entitled COMMUNICATION PROTOCOL FOR A RADIO-FREQUENCY LOAD CONTROL SYSTEM, the entire disclosures of all of which are hereby incorporated by reference. Alternatively, the wireless communication circuit may be implemented as an RF receiver for receiving RF signals, an RF transmitter for transmitting RF signals, or an infrared receiver for receiving infrared (IR) signals. In addition, the dimmer switch 502 could alternatively comprise a wired communication circuit adapted to be coupled to a wired communication link.

The dimmer switch 502 may also include an external signal detector circuit 538. The external signal detector circuit 538 may receive an external control signal from the three-way switch 504 via the external-control terminal EC. Specifically, the external control signal may be, for example, equal to approximately zero volts when the three-way switch 504 may be in position A. Additionally, the external signal may be equal to approximately the dimmed-hot signal when the three-way switch is in position B (i.e., the three-way switch 504 provides a maintained control signal to the dimmer switch 502). Alternatively, the three-way switch 504 shown in FIG. 5 may be coupled to the line-side of the system 500, such that the external control signal would be equal to approximately the AC line voltage when the three-way switch is in position B. In such examples, the controller 524 may be operable to operate in a maintained mode of operation to control the lighting load 508 in response to the external control signal. For example, the controller 524 may toggle the lighting load 508 on and off when the external control signal changes states (i.e., between zero volts and the dimmed-hot signal) when in the maintained mode of operation.

Figure 3:
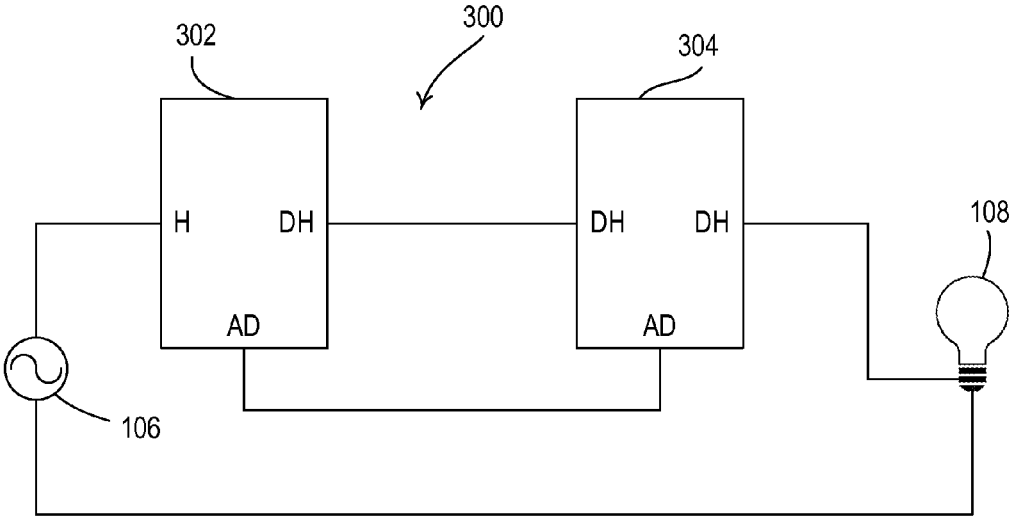
Fig. 3 PRIOR ART
FIG. 3 is a block diagram of a typical multiple location lighting control system.
Figure 4:
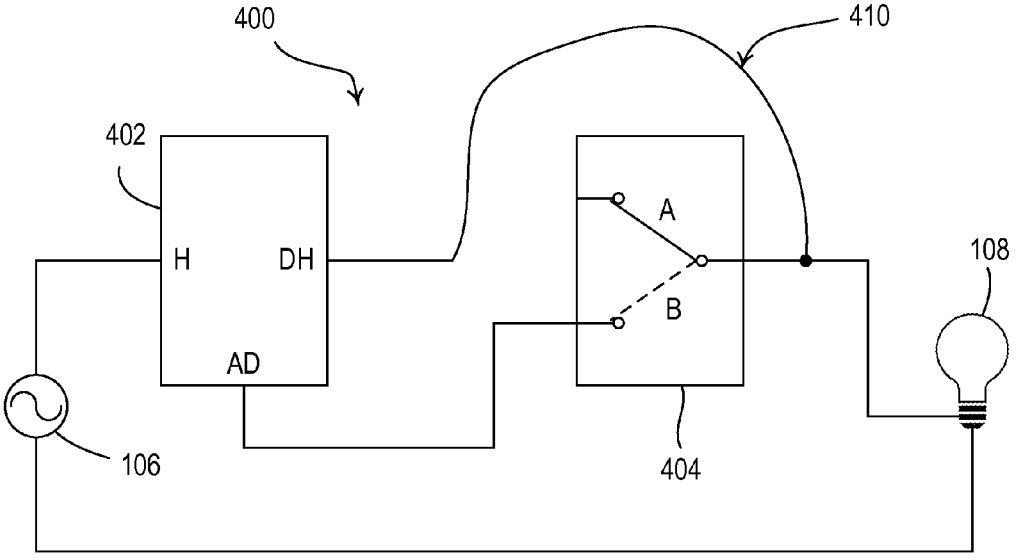
Fig. 4 PRIOR ART
FIG. 4 is a block diagram of a typical three-way dimming system with a smart three-way dimmer switch that is operable to work with a standard maintained three-way switch.

The dimmer switch 502 may also be coupled to an accessory control (e.g., rather than the three-way switch 504) via an accessory-dimmer terminal AD and may be operable to operate in a momentary mode of operation in response to the short pulses of the control signal received from the accessory control (e.g., as described with respect to the lighting control system 300 shown in FIG. 3). The accessory control may also have a toggle actuator and an intensity adjustment actuator (e.g., similar to those of the dimmer switch 502). In an example, the controller 524 may be operable to change between the maintained mode of operation and the momentary mode of operation in response to a predetermined actuation and/or a sequence of actuations of the local actuators 526 (i.e., the toggle actuator 514 and the intensity adjustment actuator 516). For example, a user of the dimmer switch 502 could press and hold the toggle actuator 514 and the upper portion 516A of the intensity adjustment actuator 516 for a predetermined amount of time (e.g., approximately five seconds) to enter a maintained or momentary programming mode that may be provided or controlled by the controller 524. The user could then press the upper and lower portions 516A, 516B of the intensity adjustment actuator 516 to select either the maintained mode of operation or the momentary mode of operation. The controller 524 may cause the LEDs 528 to blink one or more of the visual indicators 518 in the linear array that may be representative of the selected mode of operation. When the desired mode of operation may be selected (and the appropriate visual indicator 518 may be blinking), the user could then press the toggle actuator 514 to exit the maintained/momentary programming mode.

Alternatively, the controller 524 could change between the maintained mode of operation and the momentary mode of operation in response to an advanced programming procedure performed by the user of the dimmer switch 502 as described in commonly-assigned U.S. Pat. No. 7,190,125, issued Mar. 13, 2007, entitled PROGRAMMABLE WALL-BOX DIMMER, the entire disclosure of which is hereby incorporated by reference. Additionally, the controller 524 could alternatively be operable to automatically change from the momentary mode of operation to the maintained mode of operation in response to determining that the external control signal may be approximately equal to the AC line voltage or the dimmed-hot voltage for a predetermined amount of time (e.g., approximately ten seconds) as described in previously-referenced U.S. Pat. No. 7,247,999.

Figure 1:
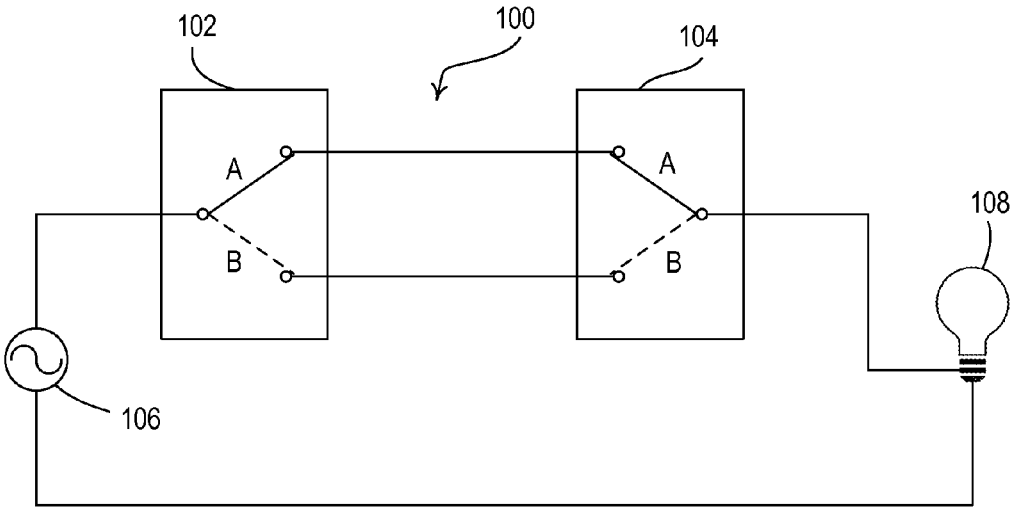
Fig. 1 PRIOR ART
FIG. 1 is a block diagram of a typical, standard three-way switch system.
Figure 2:
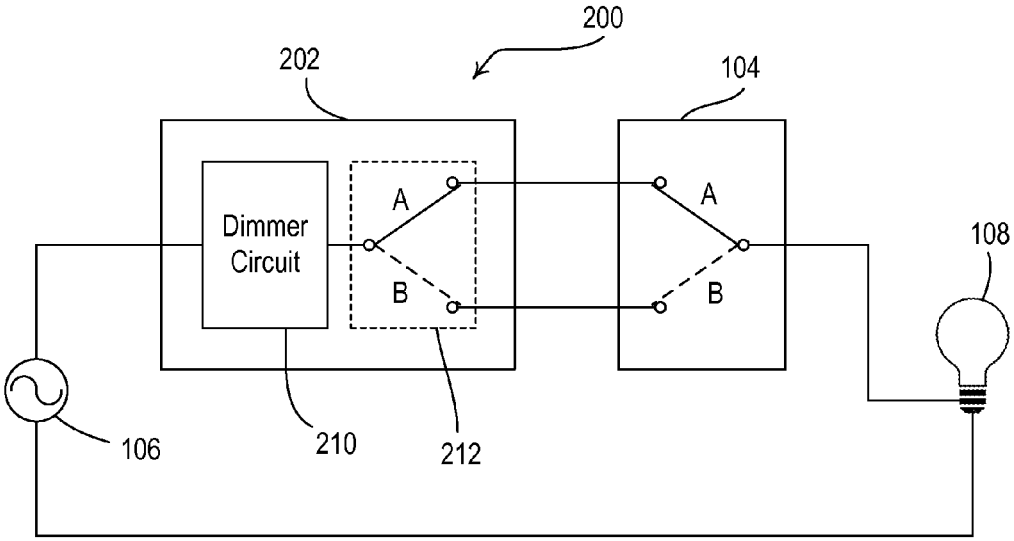
Fig. 2 PRIOR ART
FIG. 2 is a block diagram of typical three-way dimmer switch system.

When operating in the momentary mode, the controller 524 may use a first turn-on fade rate (e.g., approximately 0.75 second) when turning the lighting load 508 on and uses a first turn-off fade rate (e.g., approximately 2.50 seconds) when turning the lighting load off. The specific values of the first turn-on rate and the first turn-off rate may be adjusted using the advanced programming procedure of the dimmer switch 502 (e.g., between approximately 0.75 second and 15 seconds). When operating in the maintained mode (i.e., in response to or use of the standard three-way switch 504), the controller 524 may use a second turn-on fade rate (e.g., approximately 0.50 second) when turning the lighting load 508 on and uses a second turn-off fade rate (e.g., approximately 0.75 second) when turning the lighting load off. Since the second turn-on rate and the second turn-off rate are very short, the dimmer switch 502 adjusts the intensity of the lighting load 508 very quickly (i.e., in a similar manner to how the lighting load 108 would be controlled in the switch system 100 of FIG. 1) as may be expected by a user of the lighting controls system 500 when actuating the three-way switch 504. In another example, the second turn-on rate and the second turn-off rate could each be approximately zero seconds.

When operating in the momentary mode, the controller 524 may quickly control the lighting load 508 to the maximum intensity (e.g., using the second turn-on fade rate or a third turn-on fade rate) in response to a double tap of a toggle actuator of either the dimmer switch or a connected accessory control. The controller 524 may slowly fade the lighting load 508 off (e.g., using a fourth turn-off rate longer than the first and second turn-off rates) in response to a press and hold of a toggle actuator of either the dimmer switch or a connected accessory control when operating in the momentary mode. When operating in the maintained mode, this functionality may be disabled in response to inputs received from the external signal detector 538. For example, the controller 524 may not respond to inputs corresponding to a double tap or a press and hold received from the standard three-way switch 504 when operating in the maintained mode.

Figure 7:
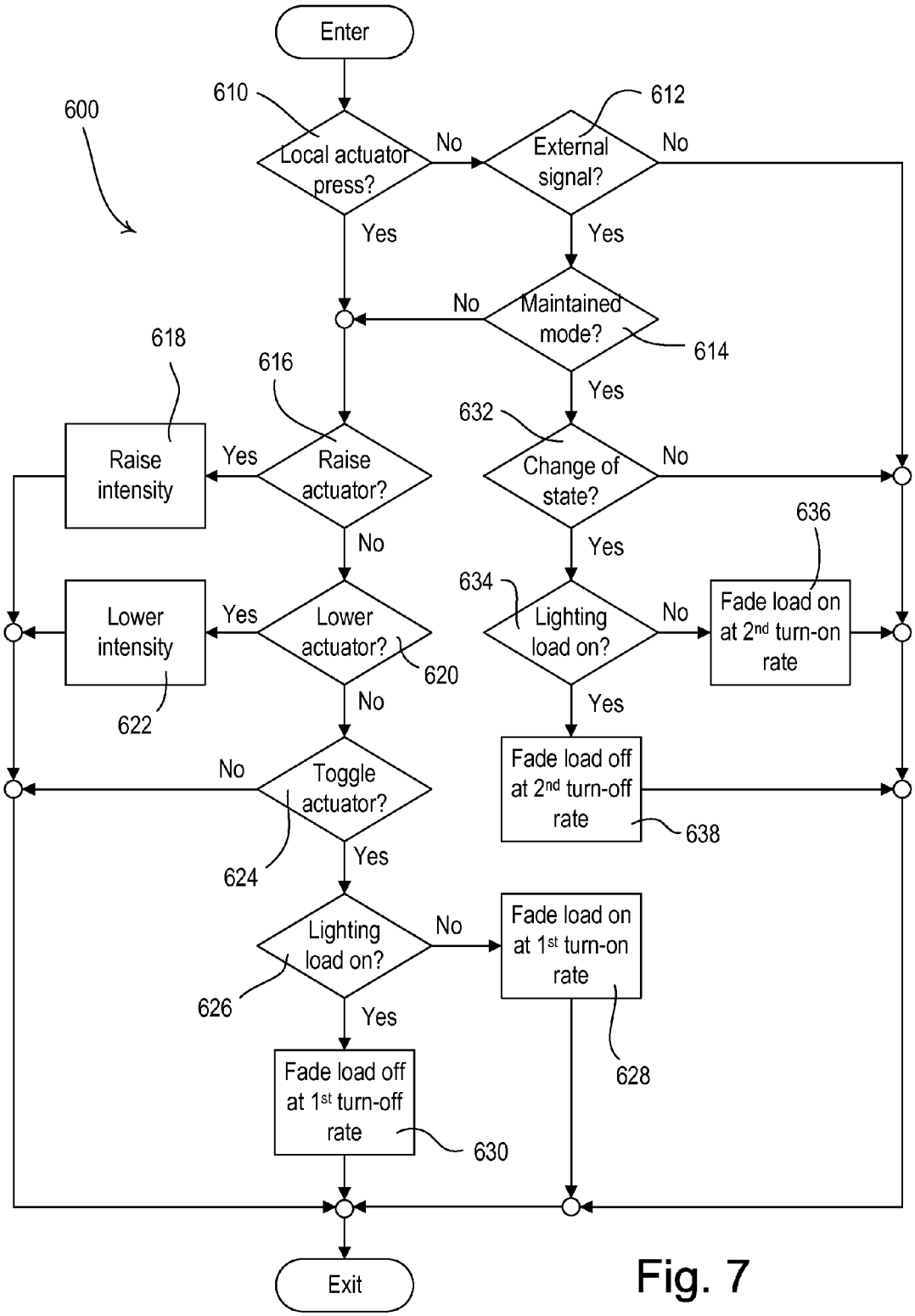
FIG. 7 is a flowchart of an example method or procedure for providing or receiving user input that may be executed the dimmer switch of FIG. 6.

FIG. 7 is a flowchart of a user input procedure 600 that is executed by the controller 524 of the dimmer switch 502 shown in FIGS. 5 and 6 in response to the actuation of one of the local actuators 526 (i.e., the toggle actuator 514 or the intensity adjustment actuator 516), or a change in the state of the external control signal received via the external-control terminal EC. As shown in FIG. 7, if a user input comes from (e.g., may be received from) the local actuators 526 at step 610, or if the user input comes from (e.g., may be received from) the external control signal at step 612 and the controller 524 is operating in the momentary mode at step 614, the controller may determine which actuator may have been pressed.

For example, the controller may determine whether a raise actuator (e.g., the upper portion 516A of the intensity adjustment actuator 516 on the dimmer switch 502) may have been pressed at step 616. If the raise actuator was pressed, for example, at step 616 on either the dimmer switch 502 or a connected accessory control, the controller 524 increases the intensity of the lighting load 508 by a predetermined amount at step 618 and the user input procedure 600 exits.

If, at step 616, the raise actuator was not pressed, the controller may determine whether a lower actuator (e.g., the lower portion 516B of the intensity adjustment actuator 516 on the dimmer switch 502) may have been pressed at step 620. If the lower actuator was pressed, for example, at step 620 on either the dimmer switch 502 or a connected accessory control, the controller 524 decreases the intensity of the lighting load 508 by the predetermined amount at step 622, before the user input procedure 600 exits.

If, at step 620, the lower actuator was not pressed, the controller may determine whether a toggle actuator (e.g., the toggle actuator 514 on the dimmer switch) may have been pressed at step 624. If the toggle actuator was pressed, for example, at step 624 on either the dimmer switch 502 or the connected accessory control, and the lighting load 508 is not on at step 626, the controller 524 turns the lighting load on using the first turn-on fade rate at step 628. If the lighting load is on at step 626, the controller 524 turns the lighting load off at the first turn-off fade rate at 630.

In an example, if the user input came from (e.g. may have been received from) the external control signal at step 612 and the controller 524 is operating in the maintained mode at step 614 (e.g., the user input was received from the standard three-way switch 504), the controller determines whether there has been a change of state of the external control signal at step 632. If there has been a change of state of the external control signal at step 632 and the lighting load is not on at step 634, the controller 524 turns the lighting load on using the second turn-on fade rate at step 636. If the lighting load is on at step 634, the controller 524 turns the lighting load off at the second turn-off fade rate at step 638.

The invention claimed is:

1. A dimmer switch for controlling an amount of power delivered from an alternating current (AC) power source to a lighting load, the dimmer switch adapted to be coupled to a standard three-way switch that is coupled to one of the source and the load, the dimmer switch comprising:

a controllably conductive device adapted to be coupled in series electrical connection between the source and the load, the controllably conductive device having a control input;

an actuator operable to receive a user input via an actuation of the actuator;

a controller operatively coupled to the actuator and the control input of the controllably conductive device for controlling the power delivered to the lighting load, wherein the controller is operable to turn off the lighting load at a first turn-off rate in response to the user input via the actuation of the actuator; and an external-control terminal adapted to receive an external control signal from the three-way switch, the controller operatively coupled to the external-control terminal for receipt of the external control signal, wherein the controller is operable to turn off the lighting load in response to the external control signal at a second turn-off rate that is faster than the first turn-off rate.

2. The dimmer switch of claim 1, wherein the first turn-off rate is approximately 2.5 seconds.

3. The dimmer switch of claim 1, wherein the second turn-off rate is approximately 0.75 seconds.

4. The dimmer switch of claim 1, wherein the controller is operable to turn on the lighting load at a first turn-on rate in response to an actuation of the actuator, and to turn on the lighting load in response to the external control signal at a second turn-on rate, wherein the second turn-on rate is faster than the first turn-on rate.

5. The dimmer of switch claim 4, wherein a lighting intensity of the lighting load is gradually increased at the first turn-on rate to turn on the lighting load and is quickly increased at the second turn-on rate to turn on the lighting load.

6. The dimmer switch of claim 4, wherein the first turn-on rate is approximately 0.75 seconds.

7. The dimmer switch of claim 4, wherein the second turn-on rate is approximately 0.5 seconds.

8. The dimmer switch of claim 1, wherein the controller is operable to turn off the lighting load in response to the external control signal at the second turn-off rate when the three-way switch is in a maintained mode of operation.

9. A dimmer switch for controlling an amount of power delivered from an alternating current (AC) power source to a lighting load, the dimmer switch adapted to be coupled to one of an accessory control having a momentary actuator or a standard maintained three-way switch that is coupled to one of the source and the load, the dimmer switch comprising:

a controllably conductive device adapted to be coupled in series electrical connection between the source and the load, the controllably conductive device having a control input;

a controller operatively coupled to the control input of the controllably conductive device for controlling the power delivered to the lighting load; and an external-control terminal adapted to be coupled to either the accessory control or the three-way switch, the controller operating in a momentary mode of operation when the accessory control is coupled to the external-control terminal and in a maintained mode of operation when the three-way switch is coupled to the external-control terminal, wherein the controller is operable to turn off the lighting load at a first turn-off rate in response to an actuation of the actuator of the accessory control, and to turn off the lighting load at a second turn-off rate that is faster than the first turn-off rate in response to an actuation of the three-way switch.

10. The dimmer switch of claim 9, wherein the first turn-off rate is approximately 2.5 seconds.

11. The dimmer switch of claim 9, wherein the second turn-off rate is approximately 0.75 seconds.

12. The dimmer switch of claim 9, wherein the controller is operable to turn on the lighting load at a first turn-on rate in response to an actuation of the actuator of the accessory control, and to turn on the lighting load at a second turn-on rate faster than the first turn-on rate in response to an actuation of the three-way switch.

13. The dimmer switch of claim 12, wherein the first turn-on rate is approximately 0.75 seconds.

14. The dimmer switch of claim 12, wherein the second turn-on rate is approximately 0.5 seconds.

15. The dimmer switch of claim 12, wherein the dimmer switch is adapted to adjust the first turn-on rate and the first turn-off between approximately 0.75 seconds and 15 seconds.

16. A method for controlling a lighting load using a dimmer switch adapted to be coupled to at least one of an accessory control or a standard maintained three-way switch that is coupled to one of a source or the lighting load, the method comprising:

receiving user input;

determining whether the user input is from an actuation of a local actuator associated with the dimmer switch or the accessory control or from an external control signal of the standard maintained three-way switch;

when the user input is from the actuation of the local actuator associated with the dimmer switch or the accessory control:

determining whether the local actuator is a toggle actuator;

turning the lighting load off at a first turn-off fade rate when the local actuator is the toggle actuator and the lighting load is on;

when the user input is from the external control signal of the standard maintained three-way switch:

determining whether a state of the external control signal has changed; and turning the lighting load off at a second turn-off fade rate that is faster than the first turn-off fade rate when the state of the external control signal has changed and the lighting load is on.

17. The method of claim 16, further comprising:

turning the lighting load on at a first turn-on fade rate when the local actuator is the toggle actuator and the lighting load is off; and turning the lighting load on at a second turn-on fade rate that is faster than the first turn-on fade rate when the state of the external control signal has changed and the lighting load is off.

18. The method of claim 17, further comprising when the user input is from the actuation of the local actuator associated with the dimmer switch or the accessory control:

determining whether the local actuator is a raise actuator; and increasing an intensity of the lighting load when the local actuator is the raise actuator.

19. The method of claim 17, further comprising when the user input is from the actuation of the local actuator associated with the dimmer switch or the accessory control:

determining whether the local actuator is a lower actuator; and decreasing an intensity of the lighting load when the local actuator is the lower actuator.

20. The method of claim 17, wherein the first turn-on fade rate is approximately 0.75 seconds.

21. The method of claim 20, wherein the first turn-off fade rate is approximately 2.5 seconds.

22. The method of claim 17, wherein the second turn-on fade rate is approximately 0.5 seconds.

23. The method of claim 22, wherein the second turn-off fade rate is approximately 0.75 seconds.

* * * * *